United States Patent [19]

Dach

[11] Patent Number: 4,624,683

[45] Date of Patent: Nov. 25, 1986

[54] QUENCH RING AND DIP TUBE COMBINATION WITH IMPROVEMENT

[75] Inventor: Michael M. Dach, Houston, Tex.

[73] Assignee: Texaco Inc., White Plains, N.Y.

[21] Appl. No.: 736,886

[22] Filed: May 20, 1985

[51] Int. Cl.[4] ..... C10J 3/72

[52] U.S. Cl. ..... 48/69; 48/87

[58] Field of Search ..... 48/69, 76, 77, 63, 87, 48/DIG. 2; 422/194, 207; 261/112, DIG. 54, DIG. 75; 110/171, 215, 216; 208/48 Q

[56] References Cited

U.S. PATENT DOCUMENTS 2,818,326 12/1957 Eastman et al. ..... 48/206

4,218,423 8/1980 Robin et al. ..... 422/207

4,300,913 11/1981 Egert et al. ..... 48/69

4,367,076 1/1983 Peise et al. ..... 48/69

4,466,808 8/1984 Koog ..... 48/DIG. 2 X

*Primary Examiner*—David L. Lacey

*Assistant Examiner*—Joye L. Woodard

*Attorney, Agent, or Firm*—Robert A. Kulason; James J. O'Loughlin; Robert B. Burns

[57] ABSTRACT

An improvement for the structure of a quench ring and dip tube combination. It is applicable to an assembly of those elements on a gasification generator at the outlet thereof. It has a hollow perforated standpipe (48) that will bleed off any accumulation of gas above the cooling water in the quench ring.

5 Claims, 3 Drawing Figures

Fig.1.
(PRIOR ART)
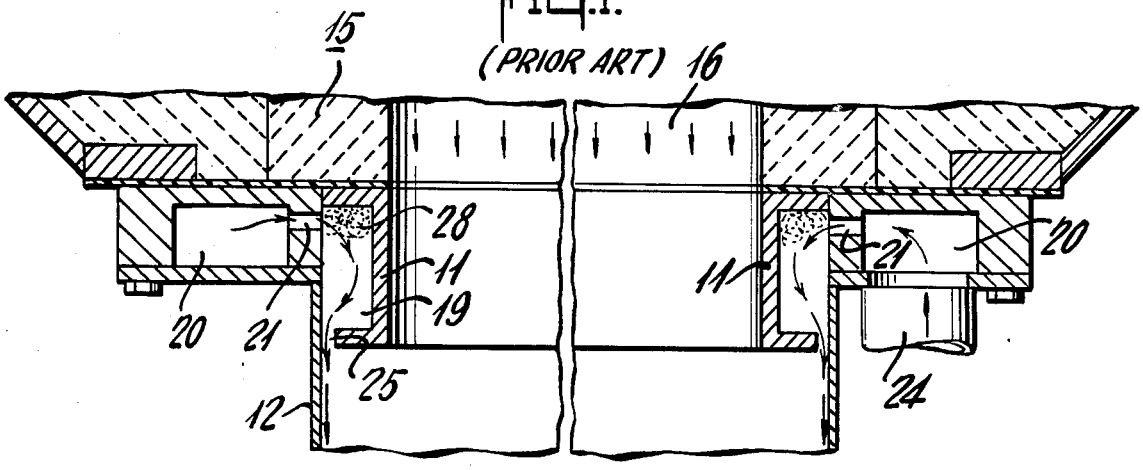
Fig.2.
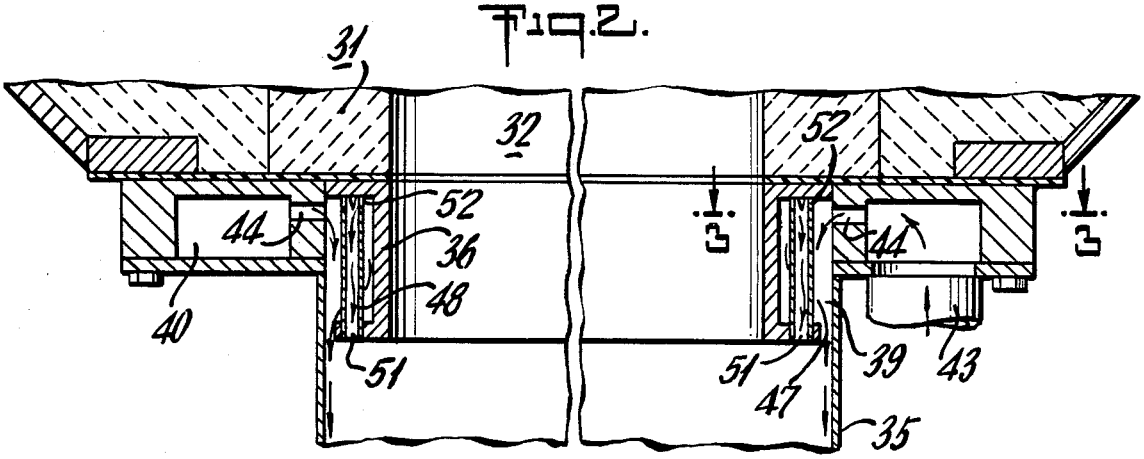
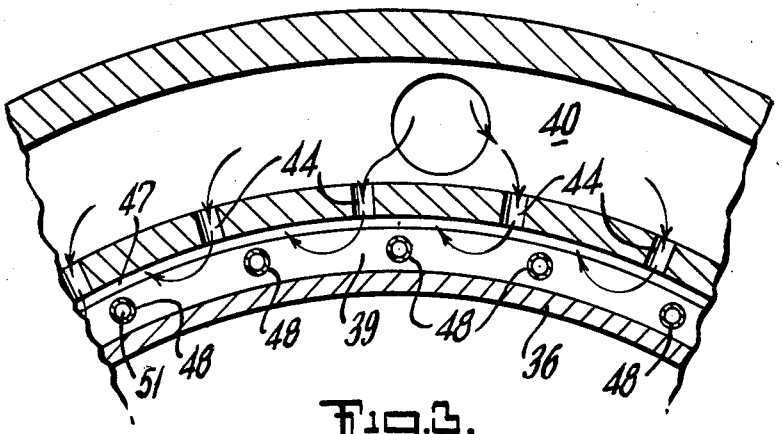
Fig.3.

QUENCH RING AND DIP TUBE COMBINATION WITH IMPROVEMENT

BACKGROUND OF THE INVENTION

1. Field of the Invention

This invention concerns an improvement for the structure of a quench ring and dip tube combination which is employed with the bottom outlet of a refractory lined reactor chamber.

2. Description of Related Art Known to the Applicant

A U.S. Pat. No. 4,218,423 issued Aug. 19, 1980 to Robin et al illustrates a type of quench ring and dip tube structure to which the improvement according to this invention applies. It has been found that quench rings of this type have suffered metal loss leading to failure by reason of sulfur attack of the nickel used in the steel alloy forming such quench rings. In the effluent from a gasification reactor there is hydrogen sulfide contained in synthesis gas leaving the reactor chamber. Furthermore, such synthesis gas is leaving at temperatures in the 2400° to 2600° F. range. It has been discovered that the quench ring is not maintained completely full of the quenching water so that a pocket of gas gathers/and exacerbates the attack of the quench ring metal.

Consequently, it is an object of this invention to provide means for eliminating any gas pocket at the top of a quench ring that carries cooling water in the operation of a quench ring and dip tube.

SUMMARY OF THE INVENTION

Briefly, the invention is an improved quench ring in combination with a dip tube at the bottom outlet of a refractory lined reactor chamber. It comprises an annular conduit for carrying cooling water therein and adapted for mounting in the top of said dip tube against said bottom outlet. It also comprises passage means for discharging said cooling water against the inside surface of said dip tube and means for bleeding off accumulation of gas from the top of said annular conduit.

Again briefly, the invention is in a combination of a quench ring and dip tube adapted for use with the outlet of a gasification generator. The said quench ring has an annular passage therein for circulating a liquid coolant therethrough, and inlet means to said annular passage for introducing said liquid coolant. The combination also includes outlet means for directing said liquid coolant onto the inside surface of said dip tube. In the combination, the improvement comprises means for bleeding off any accumulation of gas above said liquid coolant in said annular passage.

Once more briefly, the invention is an improved quench ring in combination wth a dip tube at the bottom outlet of a refractory lined reactor chamber. It comprises an annular conduit for carrying cooling water therein and adapted for mounting in the top of said dip tube and against said bottom outlet. It also comprises passage means for discharging said cooling water against the inside surface of said dip tube, and a plurality of standpipes evenly spaced around the inside of said annular conduit for bleeding any accumulation of gas from the top of said annular conduit. Each of said standpipes are connected at the bottom thereof into the inside of said dip tube, and each of said standpipes contacts the top of said annular conduit and has a plurality of passages into the inside thereof at said top of said annular conduit.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein:

FIG. 1 is a partial longitudinal cross section illustrating a quench-ring dip-tube combination according to the prior art;

FIG. 2 is a partial longitudinal cross section like FIG. 1 and illustrating an improvement of the quench ring and dip tube structure in accordance with this invention; and FIG. 3 is a fragmentary cross section view taken along the lines 3—3 of FIG. 2 and looking in the direction of the arrows.

DESCRIPTION OF THE PREFERRED EMBODIMENT

FIG. 1 illustrates the quench ring and dip tube combination of elements as applied to a refractory lined reactor chamber, in accordance with the prior art. That combination employs a quench ring 11 in conjunction with a dip tube 12 both of which are mounted at the bottom of a refractory lined reactor chamber 15 that has a bottom outlet 16. The quench ring 11 has an annular conduit 19 that is for carrying cooling water. The cooling water is introduced into the conduit 19 from an outer annular chamber 20 that surrounds the quench ring 11. The cooling water goes to the ring 11 via a plurality of passages 21 that are radially situated and connect the chamber 20 with the annular conduit 19 of the quench ring 11. The water is introduced to the chamber 20 in any feasible manner such as by an inlet pipe 24. The cooling water flows in through the pipe 24 to the annular chamber 20 and then via the passages 21 to the annular conduit 19 which is formed in the quench ring 11. It then flows out from the conduit 19 down on the inside surface of the dip tube 12 as indicated by the arrows. That flow is through a slit or series of openings 25.

It has been found that quench rings have suffered metal loss leading to failure due to sulfur attack of nickel in the alloy of the rings. The attack and the formation of $Ni_2S_3$ is promoted by high temperature and is reported to be very aggressive at or around 1300° F. Furthermore, the effluent from the reactor chamber 15 which passes down through the bottom outlet 16 and the quench ring 11 to the inside of the dip tube 12 is at temperatures in the 2400° to 2600° F. range. Also, there is hydrogen sulfide in the synthesis gas that makes up the effluent. As indicated, this is very aggressive in its attack of the metal of quench ring 11 at the high temperatures involved.

In accordance with this invention, it has been discovered that a pocket of gas 28 tends to form at the top of the quench ring 11 by evolution of gases from the circulating cooling water. That situation has led to the metal loss and failure which quench ring 11 has been subject to.

The structure according to FIGS. 2 and 3 represents a preferred embodiment in accordance with this invention. The invention was conceived in order to overcome the problem with the above described prior art.

Thus, in FIGS. 2 and 3 there is a refractory lined reaction chamber 31 which has a bottom outlet 32 through which effluent from the reaction passes on the way to the inside of a dip tube 35. In between, the effluent passes over a quench ring 36. Quench ring 36 has an annular conduit 39 formed therein which carries cooling water that is circulated from an outer annular chamber 40. The water is introduced into chamber 40 from any feasible inlet arrangement, e.g. through a pipe 43. The water flows from the chamber 40 into the annular conduit 39 through a plurality of radial connecting passages 44. From there it flows out the bottom of the conduit 39 through a slit 47 to run down the inside surface of the dip tube 35. It may be noted that the slit 47 might take the form of a plurality of openings (not shown). In either event the action is such as to provide for the cooling action of the quench ring surface as the effluent leaves the outlet 32, followed by the cooling action on the inside of the dip tube 35.

The improvement according to this invention makes use of a plurality of standpipes 48. They take the form of a plurality of small pipes that extend through the bottom wall of the quench ring 36, i.e. the floor of the annular conduit 39. These standpipes 48 are hollow and form connecting passages 51 which extend up inside each standpipe 48. There are one or more openings 52 at the top of the standpipes 48 and they are right against the top surface of the annular conduit 39.

It will be noted that by reason of having the standpipes 48 in the annular conduit 39, the pocket of gas 28 which tended to accumulate heretofore, is eliminated by having the standpipes act to hold the water level in the conduit 39 all the way to the top. Consequently, any gas which would accumulate will bleed off through the openings 52 at the tops of the standpipes 48. With this improvement, the effects of the gas accumulation are avoided, and the life of the quench ring dip tube combination is substantially increased.

It will be understood that the number of standpipes 48 employed might vary. However, there should be enough of them to avoid any gas pocket formation around the whole circumference of the conduit 39.

While a particular embodiment according to this invention has been described above in considerable detail in accordance with the applicable statute, this is not to be taken as in any way limiting the invention but merely as being descriptive thereof.

I claim:

1. In a refractory lined, gasification reactor chamber (31) having discharge means for a hot product gas from an outlet (32) in the gasification reactor bottom, an elongated dip tube (35) depending from said reactor bottom having an inner wall which defines a central effluent passage for conducting said gaseous effluent from said outlet (32), an annular quench ring (36) registered in said dip tube (35) central effluent passage, defining an annular conduit (39) intermediate said dip tube inner wall and said quench ring (36), coolant conducting means in fluid communication with a water supply, and forming an annular chamber (40) positioned adjacent to said annular conduit (39), and having at least one passage thereinbetween to deliver a stream of water thereto, wherein the improvement comprises at least one perforated wall standpipe (48) extending between the top of said annular conduit (39), and opening into said central effluent passage, whereby, hot gaseous effluent and water which enter said annular conduit (39) will be conducted by said at least one perforated wall standpipe (48) into said central effluent passage.

2. In the apparatus as defined in claim 1, wherein said at least one perforated wall standpipe (48) is provided with at least one wall perforation (52) at the end thereof adjacent the top of said annular conduit (39).

3. In the apparatus as defined in claim 1, wherein said at least one standpipe (48) is fixed in a generally upstanding position within said conduit (39).

4. In the apparatus as defined in claim 1, wherein said at least one passage comprises a plurality of passages.

5. In an apparatus as defined in claim 1, wherein said at least one standpipe (48) comprises a plurality of hollow standpipes connected to the inside of said quench ring (36) and spaced evenly around said annular conduit (39).

* * * * *